US006619992B1

(12) United States Patent
Hsiao

(10) Patent No.: US 6,619,992 B1
(45) Date of Patent: Sep. 16, 2003

(54) COMPACT AUXILIARY WALL OUTLET

(75) Inventor: Feng-Shen Hsiao, Taipei (TW)

(73) Assignee: Rite-Tech Industrial Co., Ltd., Taipei (TW)

( * ) Notice: Subject to any disclaimer, the term of this patent is extended or adjusted under 35 U.S.C. 154(b) by 0 days.

(21) Appl. No.: 10/154,612

(22) Filed: May 22, 2002

(51) Int. Cl.[7] ..... H01R 25/00
(52) U.S. Cl. ..... 439/650; 439/76.1
(58) Field of Search ..... 439/650–654, 439/214, 215, 535, 536, 76.1

(56) References Cited

U.S. PATENT DOCUMENTS 3,478,295 A * 11/1969 Grieshaber
5,572,406 A * 11/1996 Strang et al. ..... 361/407
6,045,399 A * 4/2000 Yu ..... 439/502

FOREIGN PATENT DOCUMENTS

DE 0 821 231 * 11/1951 ..... 439/650

* cited by examiner

*Primary Examiner*—Khiem Nguyen
(74) *Attorney, Agent, or Firm*—Dellett and Walters

(57) ABSTRACT

A wall outlet has two trenches respectively defined in two opposite sides in the housing of the wall outlet to corresponding to the grounding blade of a plug so that the wall outlet is compact.

2 Claims, 5 Drawing Sheets

COMPACT AUXILIARY WALL OUTLET

BACKGROUND OF THE INVENTION

1. Field of the Invention

The present invention relates to an auxiliary wall outlet, and more particularly to a miniaturized auxiliary wall outlet. The wall outlet has two trenches respectively defined in two opposite sides in the housing of the wall outlet to correspond to the grounding blade of a plug so that the thickness of the wall outlet is able to be miniaturized.

2. Description of Related Art

With reference to FIG. 5, a conventional wall outlet is shown and has a housing (50) with a unitary thickness. The housing (50) has multiple pairs of first holes (51) and second holes (52) each corresponding to one pair of first holes (51). It is known in the art that the grounding blade (not shown) has a length longer than that of two contact blades (not shown) in a plug. In order to cope with the length difference between the grounding blade and the contact blades, the housing (50) has a unitary thickness throughout the entire structure. Because the housing (50) has only one thickness, the housing is bulky and takes up a lot of space.

To overcome the shortcomings, the present invention tends to provide an improved auxiliary wall outlet to mitigate and obviate the aforementioned problems.

SUMMARY OF THE INVENTION

The primary objective of the present invention is to provide an improved auxiliary wall outlet with a non-unitary thickness. That is, the wall outlet of the present invention has two trenches respectively defined in two opposite sides of the housing of the wall outlet to correspond to the grounding blade of plug, such that the housing thickness of the wall outlet may be made different so as to reduce the thickness of the wall outlet.

In order to accomplish the objective, the auxiliary wall outlet includes a casing composed of a top casing and a bottom casing together with the top casing to define therebetween a space to receive therein electrical components, wherein the top casing has multiple first holes defined in opposite sides of the top casing to adapt to a grounding blade of a plug and multiple pairs of second holes each pair corresponding to one of the first holes to be adapted to received therein contact blades of the plug; and two trenches respectively defined in opposite sides in the bottom casing, each trench corresponding to the first holes. Whereby, formation of the trenches makes a part of the bottom casing to have a thickness larger than a thickness of other parts free of the formation of the trenches.

Other objects, advantages and novel features of the invention will become more apparent from the following detailed description when taken in conjunction with the accompanying drawings.

DETAILED DESCRIPTION OF THE PREFERRED EMBODIMENT

Figure 1:
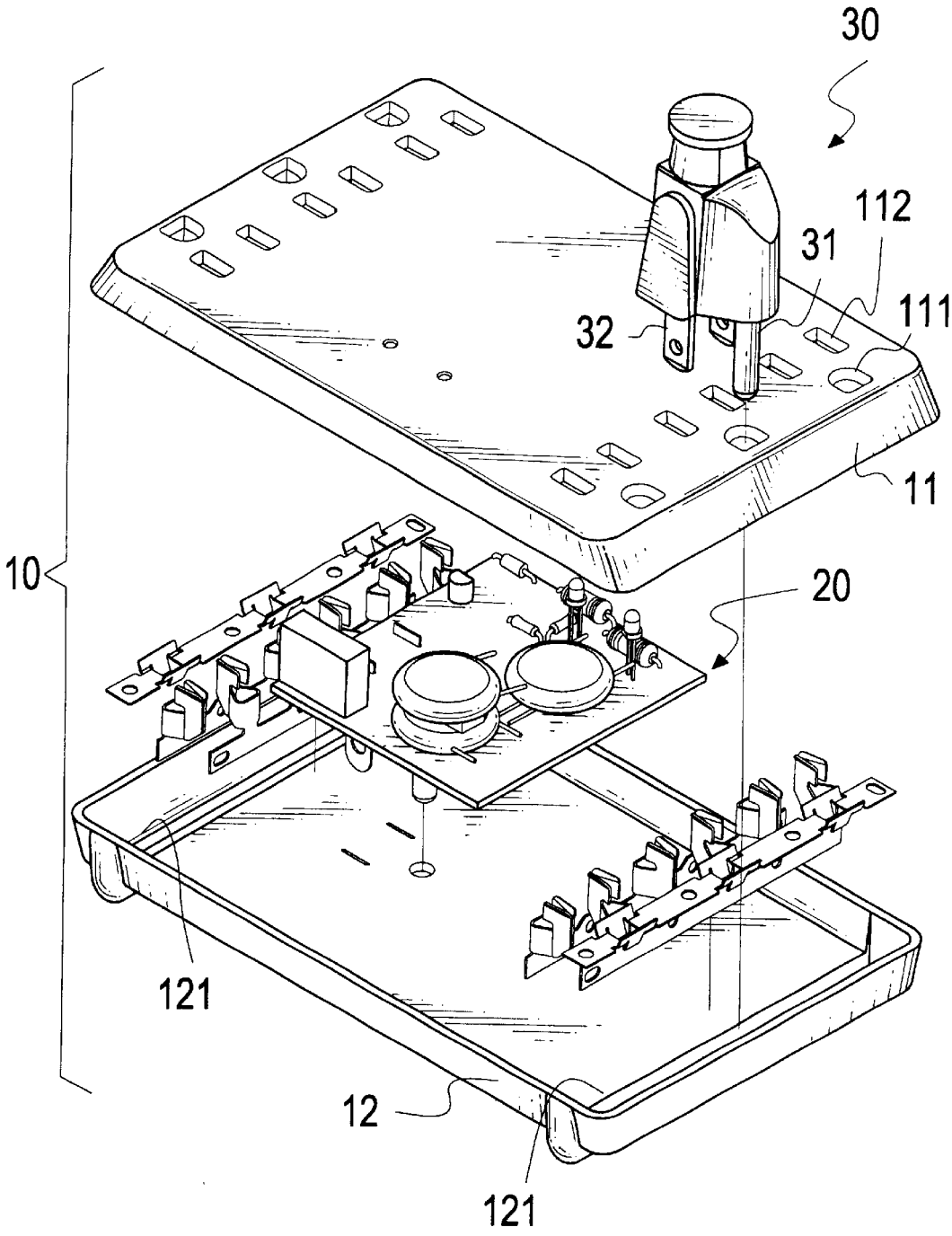
FIG. 1 is an exploded perspective view showing the structure of the auxiliary wall outlet of the present invention.
Figure 2:
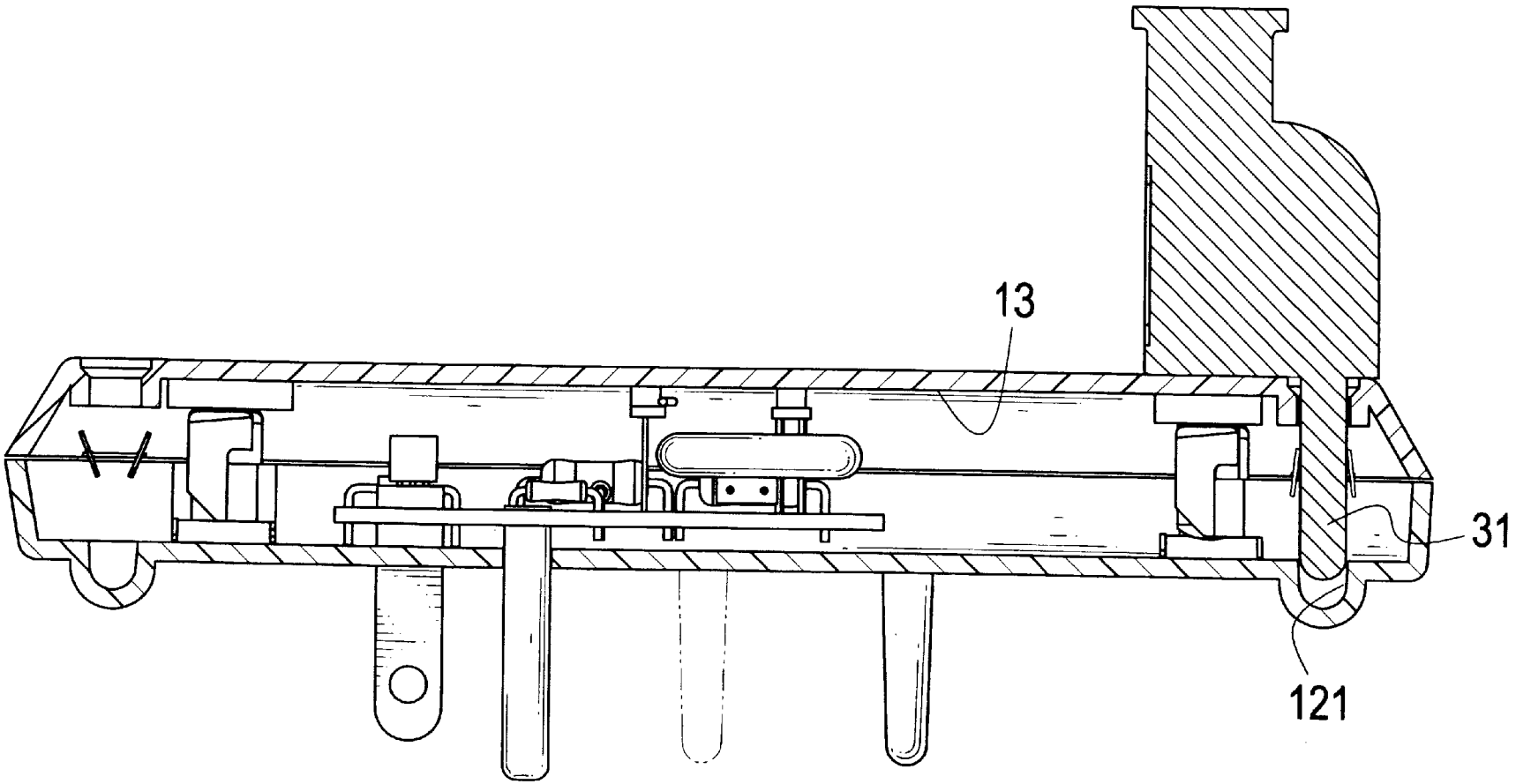
FIG. 2 is a cross sectional view showing in dashed lines that the auxiliary wall outlet is adapted to connect to a plug.

With reference to FIG. 1, the auxiliary wall outlet constructed in accordance with the present invention has a housing (10) composed of a top casing (11) and a bottom casing (12) together with the top casing (11) to define therebetween a space (13) (as shown in FIG. 2) to receive therein an electrical component (20). The top casing (11) has multiple first holes (111) defined in opposite sides of the top casing (11) and multiple pairs of second holes (112) each pair corresponding to one of the first holes (111).

The bottom casing (12) has two trenches (121) defined in two opposite sides of the bottom casing (12). Each trench (121) is defined to correspond to the first holes (111).

With reference to FIG. 2 and still taking FIG. 1 for reference, a plug (30) has a grounding blade (31) with a length and two contact blades (32) with a length shorter than the grounding blade (31) length. Therefore, when the plug (30) is inserted into the auxiliary wall outlet of the present invention, the grounding blade (31) extends into one of the first holes (111) and thus is received in one of the trenches (121). From the display of FIGS. 1 and 2, it is noted that the bottom casing (12) thickness is not unitary. That is to say, the portion where the trench (121) is formed has a larger thickness than portions without the formation of the trenches (121). Therefore, the wall outlet is compact and slimline.

Figure 3:
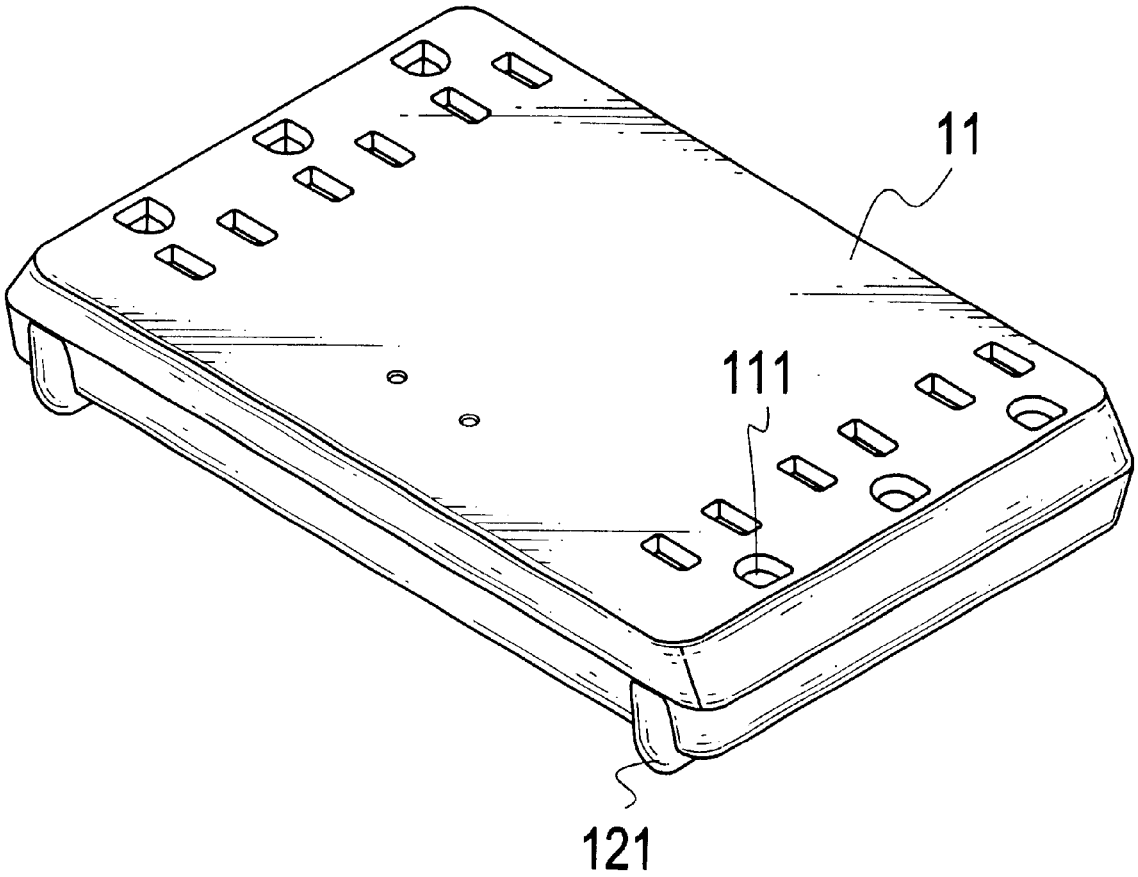
FIG. 3 is a perspective view of the auxiliary wall outlet.
Figure 4:
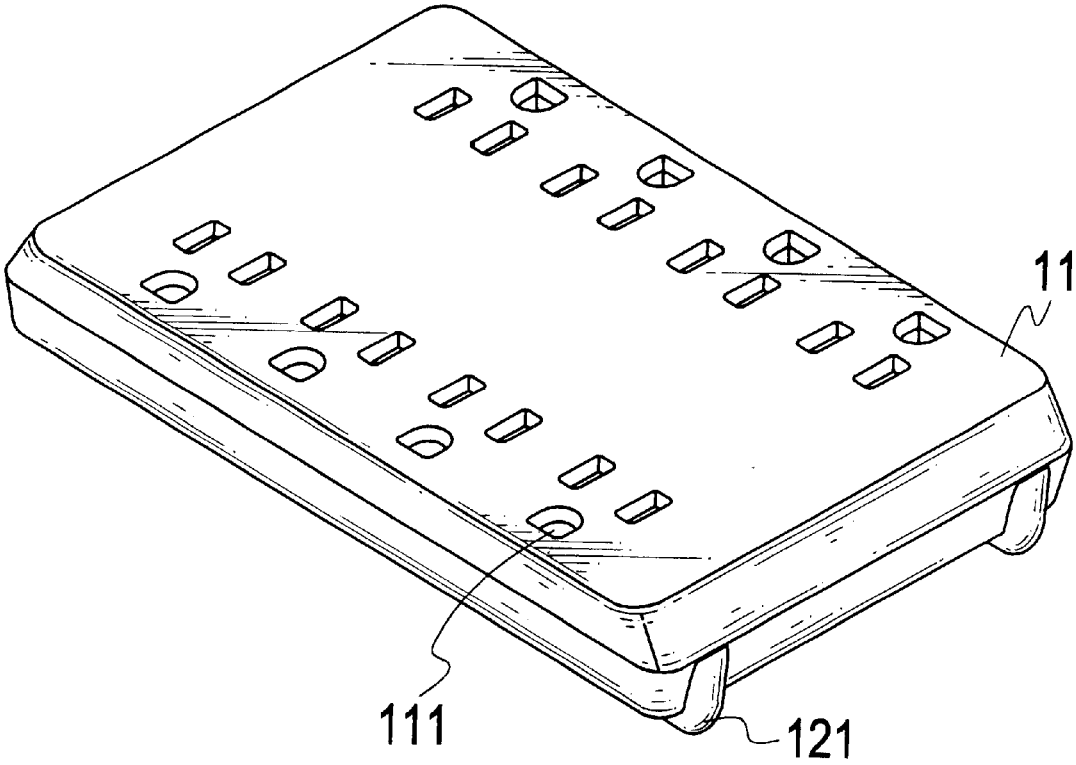
FIG. 4 is a perspective view of the auxiliary wall outlet of another preferred embodiment.
Figure 5:
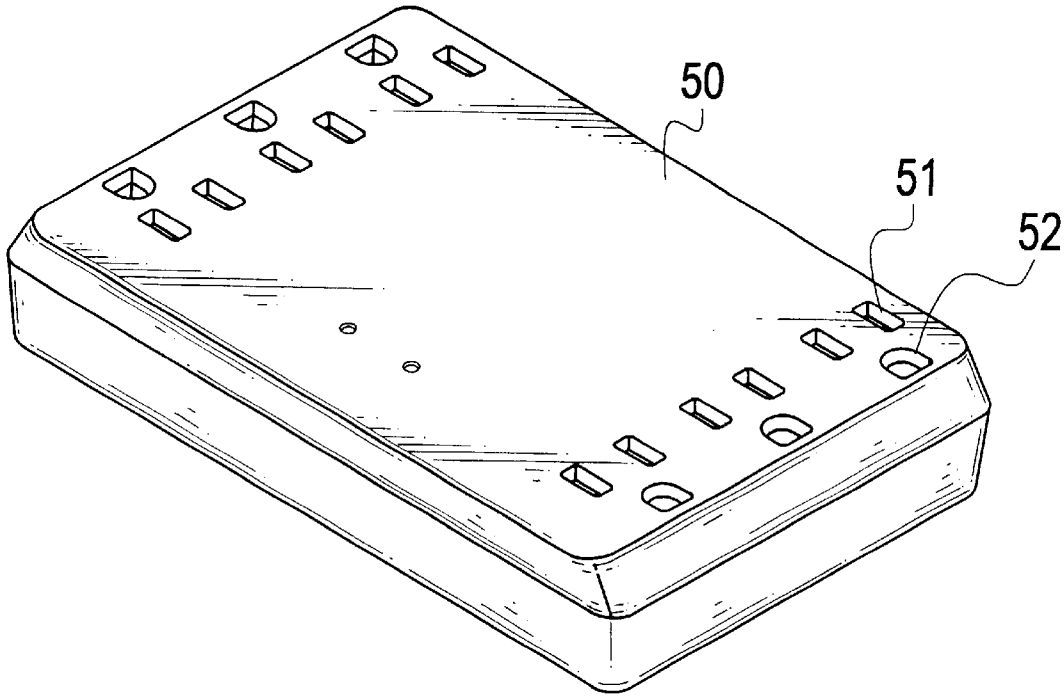
FIG.5 PRIOR ART
FIG. 5 is a perspective view of a conventional wall outlet.

With reference to FIGS. 3 and 4, it is noted that due to the corresponding relationship between the trenches (121) and the first holes (111), the first holes (111) are able to be defined in either side of the top casing (11) and still fulfil the need of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An auxiliary wall outlet comprising:

a housing composed of a top casing and a bottom casing together with the top casing to define therebetween a space to receive therein electrical components, wherein the top casing has multiple first holes defined in opposite sides of the top casing to adapt to a grounding blade of a plug and multiple pairs of second holes each pair corresponding to one of the first holes to be adapted to receive therein contact blades of the plug; and at least one trench defined in a bottom face of the bottom casing to correspond to the first holes, whereby formation of the trenches makes a part of the bottom casing to have a thickness larger than a thickness of other parts free of the formation of the trenches.

2. The auxiliary wall outlet as claimed in claim 1, wherein there are two trenches respectively defined in opposite sides in the bottom casing.

M

* * * * *